US006179058B1

(12) United States Patent
Wittrisch

(10) Patent No.: US 6,179,058 B1
(45) Date of Patent: Jan. 30, 2001

(54) MEASURING METHOD AND SYSTEM COMPRISING A SEMI-RIGID EXTENSION

(75) Inventor: Christian Wittrisch, Rueil Malmaison (FR)

(73) Assignee: Institut Francis du Petrole, Rueil-Malmaison (FR)

( * ) Notice: Under 35 U.S.C. 154(b), the term of this patent shall be extended for 0 days.

(21) Appl. No.: 09/168,685

(22) Filed: Oct. 9, 1998

(30) Foreign Application Priority Data

Oct. 13, 1997 (FR) ..... 97 12869

(51) Int. Cl.[7] ..... E21B 23/14; E21B 47/01

(52) U.S. Cl. ..... 166/384; 166/50; 166/65.1; 166/66; 166/385; 73/152.17; 73/865.8; 405/154

(58) Field of Search ..... 166/50, 65.1, 66, 166/66.4, 250.01, 77.2, 384, 385; 73/152.17, 865.8, 866.5; 405/154, 156, 174, 184

(56) References Cited

U.S. PATENT DOCUMENTS

| | | | | |
|---|---|---|---|---|
| 3,401,749 | * | 9/1968 | Daniel | 166/772 X |
| 4,485,870 | | 12/1984 | Walulik . | |
| 4,676,310 | | 6/1987 | Scherbatskoy et al. | 166/65.1 |
| 4,901,804 | * | 2/1990 | Thometz et al. | 166/66 X |
| 4,951,758 | * | 8/1990 | Sonku et al. | 166/66 X |
| 5,111,880 | * | 5/1992 | Witrisch et al. | 166/385 |
| 5,184,682 | * | 2/1993 | Delacour et al. | 166/385 |
| 5,353,872 | * | 10/1994 | Wittrisch | 166/385 X |
| 5,505,259 | * | 4/1996 | Wittrisch et al. | 166/65.1 X |
| 5,947,213 | * | 9/1999 | Angle et al. | 166/250.01 X |
| 6,003,606 | * | 12/1999 | Moore et al. | 166/50 X |

FOREIGN PATENT DOCUMENTS

| | | |
|---|---|---|
| 19534696 | 3/1997 | (DE) . |
| 0 352 148 | 1/1990 | (EP) . |
| 2 240 566 | 1/1991 | (GB) . |
| 93/18277 | 9/1993 | (WO) . |

OTHER PUBLICATIONS

Østvang, K., et al., "Wireline tractor operations successful in horizontal wells," *World Oil*, vol. 218, No. 4, Apr. 4, 1997, pp. 125–126, 128, 130, 132.

"Downhole tractors expand extended reach possibilities," *Offshore*, vol. 55, No. 8, Aug., 1995, p. 28.

* cited by examiner

*Primary Examiner*—George Suchfield
(74) *Attorney, Agent, or Firm*—Millen, White, Zelane, & Branigan, P.C.

(57) ABSTRACT

A system for displacing instruments in a pipe including a portion that is greatly inclined to the vertical. The system includes a set of instruments mechanically linked, by means of an extension, to a first end of electrically-powered displacement device. The extension is a section of a composite, semi-rigid rod that can be wound around a drum and comprises at least one electric conductor. The present invention also relates to a method for implementing the system. Application is to greatly inclined oil wells and to lateral holes.

18 Claims, 2 Drawing Sheets

MEASURING METHOD AND SYSTEM COMPRISING A SEMI-RIGID EXTENSION

FIELD OF THE INVENTION

The present invention relates to a system and to a method intended for measurement and/or servicing in wellbores or in pipes. The method is particularly well-suited to pipes comprising a substantially horizontal portion of substantial length.

BACKGROUND OF THE INVENTION

In the field of well logging, there are several well-known methods for displacing measuring instruments in both greatly inclined and horizontal pipes. It is possible to use drill rods made up end to end and equipped with a transmission cable placed in the inner space thereof, a continuous steel tubing (cabled coiled tubing) also comprising a transmission cable, or mechanical means for displacing measuring tools, such as hydraulically, electrically or electro-hydraulically-powered tractors. Measuring sonde tractors are generally fed by an electric cable which supplies electric power to an electric motor driving a high-pressure hydraulic pump. The high-pressure hydraulic fluid actuates wheels placed against the wall of the well or of the pipe. The tensile or thrust force is of the order of 5 to 10 kN. These tractors are mechanically complex and they are not currently available with small outside diameters. For example, in the case of the most powerful tractors on the market, the latter cannot be fed into pipes having an inside diameter below 6 inches (152 mm).

In a certain number of well patterns, the cased pipe is extended by a drain hole drilled by means of a tool whose diameter is smaller than the inside diameter of the cased pipe. The tractor used for maneuvering instruments or equipments in the wellbore cannot enter the drain hole.

SUMMARY OF THE INVENTION

The present invention thus relates to a system for displacing instruments in a pipe comprising a portion greatly inclined to the vertical. The system comprises a set of instruments mechanically linked to a first end of electrically-powered displacement means by an extension of determined length. The extension comprises a section of a semi-rigid composite rod that can be wound round a drum and comprising at least one electric conductor.

The instruments comprises measuring sounds, cameras, inflatable packer, plug or valve type well equipment and wall perforation tools.

The displacement means is actuated by a logging type cable, a continuous cabled metal tube, a semi-rigid composite rod, or by a combination thereof.

The pipe comprises a portion sufficiently inclined to allow weights to move under the effect of gravity. In this case, the system comprises from the bottom to the surface, a set of instruments, an extension made up of a semi-rigid rod section or electric displacement means, a semi-rigid rod section or weighting bars suspended in the pipe by a cable wound around a winch outside said pipe.

The invention also relates to a method of displacing instruments in a pipe comprising a portion greatly inclined to the vertical. The method comprises the following stages:

fastening a set of instruments to a first end of a section of a semi-rigid composite rod of sufficient flexibility to be wound round a drum and comprising at least one electric conductor, connecting a second end of said section to a first end of electrically-powered displacement means placed in said pipe portion, and displacing said set of instruments through the action of said displacement means in a second pipe into which said displaceemnt means cannot be fed.

The displacement means is connectable to the outside of the pipe by means of at least a second semi-rigid rod section.

The second semi-rigid rod section can be continuous up to the surface and displacement of the instruments can be assisted by exerting a thrust on the second rod section by actuating mechanical means for injecting the rod into the well.

Displacement of the instruments can be assisted by fastening weighting bars onto said second rod section and by suspending said bars in the pipe by a logging type cable.

The invention can be applied to oil wells comprising an uncased drain hole.

In a variant, the invention can also be applied to a lateral hole drilled from said pipe portion.

BRIEF DESCRIPTION OF THE DRAWINGS

Other features and advantages of the present invention will be clear from reading the description hereafter of non limitative examples, with reference to the accompanying drawings wherein.

DETAILED DESCRIPTION OF THE INVENTION

Figure 1:
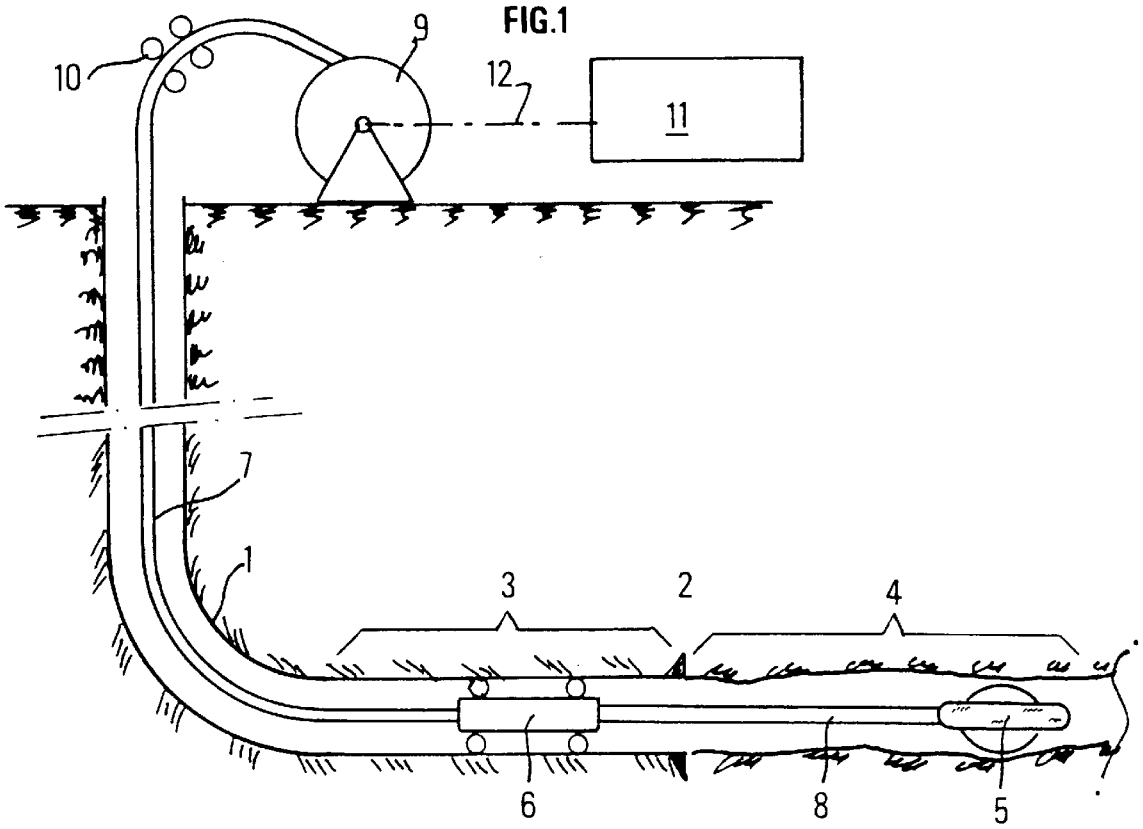
FIG. 1 diagrammatically shows the invention applied according to a first well pattern variant, FIG. 2 describes a second application relative to a well equipped with a lateral hole.

In FIG. 1, reference number 1 relates to a well drilled in the ground and cased by means of a tubing ending at shoe 2. The well 1 comprises a substantially horizontal or greatly inclined zone 3.

Well 1 is extended by a hole whose nominal diameter is smaller than the inside diameter of the casing of well 1, generally by at least one inch (25,4 mm). The well portion drilled beyond casing shoe 2 bears reference number 4. This hole portion can exhibit any possible pattern, horizontal, inclined downwards, upwards, etc.

In the instance illustrated here, well portion 4 is not cased, i.e. it is an open hole. It may be an exploratory borehole or an exploitation borehole for development of a geologic zone crossed through by hole 4 wherein the rock is stable enough not to require casing by means of a string of production tubes.

However, it is often essential to be able to displace a set of instruments or equipment in well portion 4. Considering the horizontal or practically horizontal pattern of well 1, tractor type 6 displacement means have to be used, which can move in the casing of well 1 by means of the electric power transmitted from the surface by linking means 7 comprising at least one electric conductor. There are well-known tractor type displacement means, for example those described in document WO-93/18,277 mentioned here by way of reference. The outside diameter of the tractor does not allow it to be fed into well portion 4. According to the present invention, the set of instruments 5 is fastened to tractor 6 by means of a composite extension 8 so as to form a semi-rigid rod suited to withstand the thrust provided by displacement means 6 and flexible enough to be wound round a storage drum. The length of extension 8 is determined as a function of the length of well portion 4 where the instruments are to be displaced for measuring or servicing operations. Semi-rigid extension 8 can be manufactured according to the description of document EP-352,148-B1 mentioned here by way of reference.

Linking means 7 can be a logging type cable unwound from a surface winch 9, a continuous cabled coiled tubing type metal tube, i.e. comprising a cable in the inner space thereof, or a semi-rigid composite rod of the same type as extension 8. Using linking means 7 in the form of a semi-rigid rod allows to obtain a complementary thrust by actuating rod injection means 10. The mechanical compressive strength of said rod and the lightness thereof favour the displacement efficiency. For all the embodiments of linking means 7, a control cab 11 is connected to the transmission lines by connection means 12 comprising a rotating collector at the level of the shaft of winch 9. The cab also controls the electric power supplied to tractor 6 by means of the conductors of rod 7.

Figure 2:
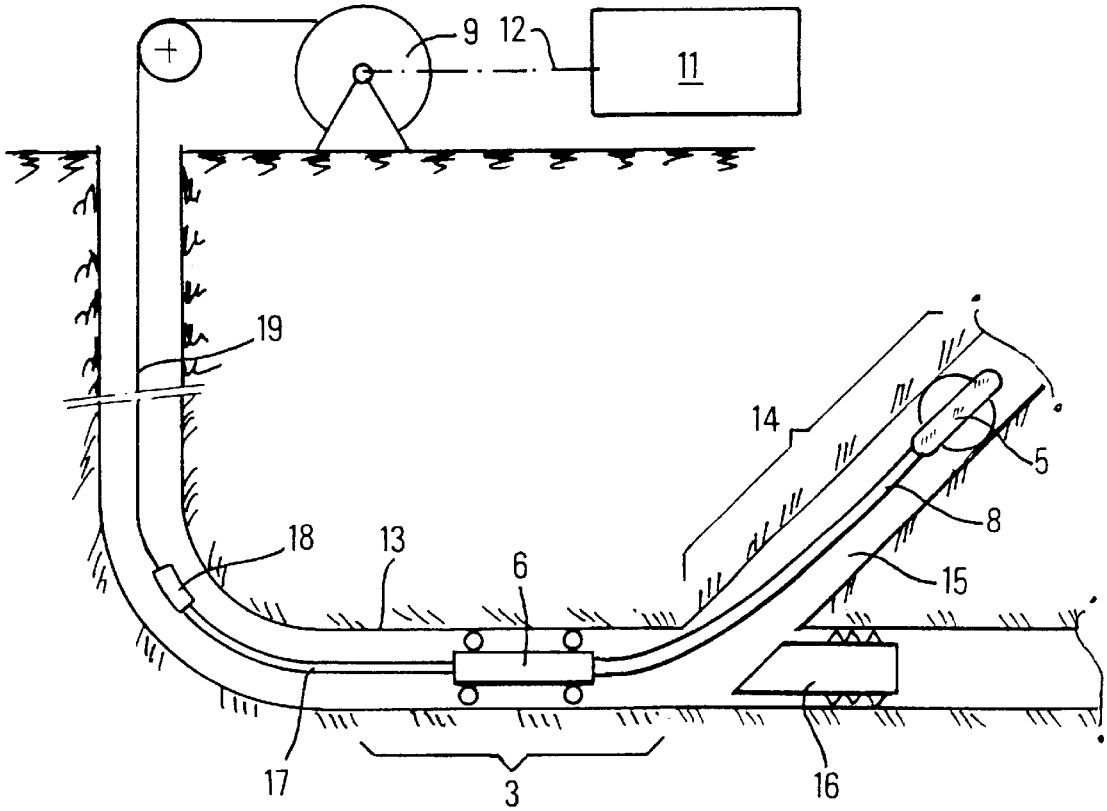

FIG. 2 diagrammatically shows an application instance where a lateral hole 14 is drilled from a main well 13 comprising a substantially horizontal portion 3. Lateral hole 14 is drilled according to well-known techniques using lateral deflection means 16 and tools for opening up a window 15 in the casing of main well 13, either by machining or by displacing a lateral sleeve included in the casing. Tractor 6 lowered in main well 13 in order to displace the instruments in lateral hole 14 cannot enter lateral hole 14 either because of the aforementioned drawbacks for the instance illustrated by FIG. 1, i.e. the diameter of the lateral hole is too small in relation to the outside diameter of said tractor, or because the deflection angle is too acute to allow the tractor to enter lateral branch 14 without any risks. According to the invention, instruments 5 are fastened to tractor 6 by means of a semi-rigid composite extension 8 whose flexibility allows passage thereof through the lateral window.

FIG. 2 also shows another embodiment of the linking means between the tractor and the ground surface. A semi-rigid rod section 17 is fastened to tractor 6. The semi-rigid rod is surmounted by a ballast 18, for example in the form of weighting bars, in a zone where main well 13 is so inclined that the ballast is active enough to exert a thrust force on semi-rigid rod section 17. Ballast 18 is suspended by an armoured logging type cable 19. The surface installation comprises a winch 9 for cable 19, means 12 allowing connection with a control cab or installation 11.

Figure 3:
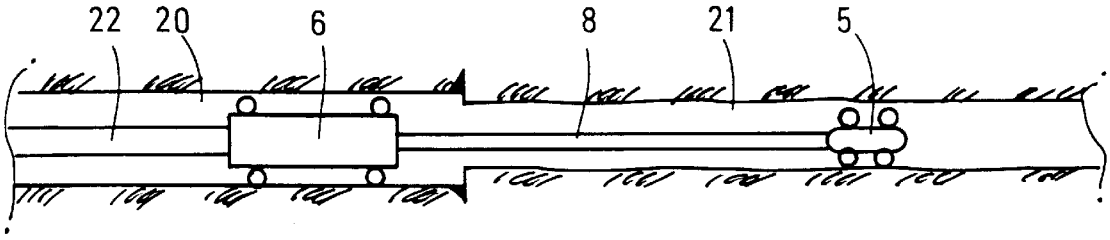
FIG. 3 illustrates another application instance where the pipes are tubes of different diameters.

FIG. 3 illustrates more precisely the use of the present invention in a line comprising two pipes having two different diameters 20 and 21. The present invention comprising a tractor 6, an extension 8 consisting of a semi-rigid composite rod and a set of instruments 5 is implemented in said pipes by linking means 22 allowing connection with the outside of pipe 20 where the tractor is situated. As described in connection with FIG. 1, linking means 22 can be a semi-rigid rod, a coiled tubing or a cable.

The application according to FIG. 3 shows that the present invention is not limited to oil wells drilled from the ground with a first substantially vertical well portion, but that it can be advantageously applied to effluent transportation lines, gas pipelines, oil pipelines, underground gathering lines, or service lines in mines or tunnels.

What is claimed is:

1. A system for displacing instruments (5) in a pipe (1) comprising a portion (3) greatly inclined to the vertical, characterized in that said system comprises a raising and lowering flexible member which is wound on and unwindable from a drum (9), an electrically operable displacement means (6) connected to the flexible member, a set of instruments (5) mechanically connected to the electrically-powered displacement means (6) by an extension (8) of determined length, said extension comprising a section of a semi-rigid composite rod windable on a drum and including at least one electric conductor coextensive therewith; whereby the extension (8) allows the set of instruments (5) to reach portions of well holes and pipes not accessible by the displacement means 6.

2. A system as claimed in claim 1, wherein said instruments (5) may include measuring probes, cameras, an inflatable packer, a plug valve type well equipment and wall perforation tools.

3. A system as claimed in claim 2, wherein said displacement means (6) are actuated by a logging type cable (19), a cabled continuous metal tube, a semi-rigid composite rod (17) or by a combination thereof.

4. A system as claimed in claim 2, wherein a pipe (13) comprises a portion that is inclined enough to allow weights (18) to move under the effect of gravity, said system comprises, from the bottom to the surface, a set of instruments (5), the extension (8) consisting of a semi-rigid rod section, the displacement means (6) with a semi-rigid rod section (17), weighting bars (18) suspended in the pipe by a cable (19) wound round the drum (9) disposed outside of said pipe.

5. A method for displacing instruments in an oil well configured as an uncased drain hole, comprising a portion greatly inclined to the vertical, comprising:

fastening a set of instruments to a first end of a section of a semi-rigid composite rod that is windable round a drum and comprising at least one electric conductor, connecting a second end of said section to a first end of electrically-power displacement means positioned in said pipe portion, and displacing said set of instruments through the action of said displacement means in a second pipe into which said displacement means cannot be fed.

6. A method as claimed in claim 5, wherein said displacement means are connected to the outside of the pipe by at least a second semi-rigid rod section.

7. A method as claimed in claim 6, wherein the second semi-rigid rod section is continuous up to the surface and wherein displacement of the instruments is assisted by exerting a thrust on the second rod section by actuating mechanical means (10) injecting rod (7) into the pipe.

8. A method as claimed in claim 6, wherein displacement of the instruments is assisted by fastening weighting bars onto said second rod section and by suspending said bars in the pipe by a logging type cable.

9. A system as claimed in claim 1, wherein said displacement means are actuated by means of a logging type cable, a cabled continuous metal tube, a semi-rigid composite rod or by a combination thereof.

10. A system as claimed in claim 1, wherein pipe comprises a portion that is inclined enough to allow weights to move under the effect of gravity, said system comprises, from the bottom to the surface, a set of instruments, an extension consisting of a semi-rigid rod section, electric displacement means, a semi-rigid rod section, weighting bars suspended in the pipe by a cable wound round a winch outside of said pipe.

11. A method for displacing instruments in an oil well configured as an uncased drain hole having a portion greatly inclined to the vertical, comprising:

fastening a set of instruments to a first end of a section of a semi-rigid composite rod that is windable around a drum and includes at least one electric conductor, connecting a second end of said section to a first end of electrically-power displacement means positioned in said pipe portion, and displacing said set of instruments through the action of said displacement means in a second pipe into which said displacement means cannot be fed.

12. A method as claimed in claim 11, wherein said displacement means are connected to the outside of the pipe by at least a second semi-rigid rod section.

13. A method as claimed in claim 12, wherein the second semi-rigid rod section is continuous up to the surface and wherein displacement of the instruments is assisted by exerting a thrust on the second rod section by actuating mechanical means for injecting the rod into the pipe.

14. A method as claimed in claim 12, wherein displacement of the instruments is assisted by weights on said second rod section and by suspending said bars in the pipe by a logging type cable.

15. A method for displacing instruments in a pipe comprising a portion greatly inclined to the vertical, and a portion laterally from the pipe portion, comprising:

fastening a set of instruments to a first end of a section of a semi-rigid composite rod that is windable around a drum and includes at least one electric conductor, connecting a second end of said section to a first end of electrically-power displacement means positioned in said pipe portion, and displacing said set of instruments through the action of said displacement means in a second pipe into which said displacement means cannot be fed.

16. A method as claimed in claim 15, wherein said displacement means are connected to the outside of the pipe by at least a second semi-rigid rod section.

17. A method as claimed in claim 16, wherein the second semi-rigid rod section is continuous up to the surface and wherein displacement of the instruments is assisted by exerting a thrust on the second rod section by actuating mechanical means for injecting rod into the pipe.

18. A method as claimed in claim 15, wherein displacement of the instruments is assisted by weights on said second rod section and by suspending said bars in the pipe by a logging type cable.

* * * * *